US006182468B1

(12) United States Patent
Stothers

(10) Patent No.: US 6,182,468 B1
(45) Date of Patent: Feb. 6, 2001

(54) THERMODYNAMIC SEPARATION OF HEAVIER COMPONENTS FROM NATURAL GAS

(75) Inventor: William R. Stothers, Calgary (CA)

(73) Assignee: Ultimate Process Technology, Calgary ( * ) Notice: Under 35 U.S.C. 154(b), the term of this patent shall be extended for 0 days.

(21) Appl. No.: 09/257,352

(22) Filed: Feb. 22, 1999

(51) Int. Cl.[7] ..... F25J 3/00
(52) U.S. Cl. ..... 62/621; 62/630
(58) Field of Search ..... 62/630, 621, 631

(56) References Cited

U.S. PATENT DOCUMENTS 4,770,683 * 9/1988 Stothers ..... 62/630
5,881,569 * 3/1999 Campbell et al. ..... 62/621

FOREIGN PATENT DOCUMENTS 370611 10/1989 (EP) .
WO 95/10011 4/1995 (WO) .

* cited by examiner

*Primary Examiner*—William Doerrler

(74) *Attorney, Agent, or Firm*—Adrian D. Battison; Murray E. Thrift; Michael R. Williams

(57) ABSTRACT

A process for separation of particularly propane, methane or ethane from natural gas includes providing a distillation tower arrangement for separating the heavier components discharged at the bottom from lighter gas discharged at the top with at least two separate towers at different pressures such that the heavier product from the higher pressure tower is expanded and fed to the lower pressure tower. A feed gas containing the components under a first pressure is separated into a first proportion and a second proportion, where neither proportion is zero. The first proportion is fed to the tower. The second proportion is compressed to a pressure higher than the first pressure, heat is extracted from the compressed second proportion to effect condensation thereof, the compressed condensed second proportion is sub-cooled, expanded to the first pressure and supplied after expansion to the distillation tower arrangement at a position thereon adjacent the top of the distillation tower arrangement so as to cause cooling of the materials in the distillation tower arrangement. The method is particularly advantageous in a low pressure supply system in which the lighter gas discharged at the top of the tower arrangement is supplied at a pressure less than 100 psi and more preferably less than 75 psi.

20 Claims, 5 Drawing Sheets

THERMODYNAMIC SEPARATION OF HEAVIER COMPONENTS FROM NATURAL GAS

BACKGROUND OF THE INVENTION

The present invention relates to the separation of hydrocarbon gases into components of differing boiling points. The invention relates more specifically to a method and an apparatus especially suited for separating propane, methane or ethane from natural gas.

The applicant's prior U.S. Pat. No. 4,770,683, issued Sep. 13, 1988, describes a process and an apparatus for distillation of two materials of differing boiling points. A process for distillation of two materials of differing boiling points particularly propane, ethane or carbon dioxide from natural gas is described in which the conventional distillation tower is divided into a first tower at higher pressure than a conventional tower and a second tower at lower pressure. Liquid drawn from the first is expanded to the lower pressure through two or more stages with cool extracted at each stage and used to cool gas withdrawn from the top of the first tower to keep the top tray at a required temperature. Gas withdrawn from the second tower is compressed and cooled for return to the first tower as a reflux. The use of the cool from the expanded liquid and the use of the two towers provides an improved thermodynamic efficiency and avoids the use of costly turbo-expanders.

In addition, a further arrangement by the present applicant is disclosed in PCT published application WO95/10011 of Apr. 13, 1995. This discloses an improvement to the above patent in which efficiency is enhanced by the provision of a third tower and an arrangement by which additional cool is supplied to the top of the high pressure tower as a reflux.

Traditionally natural gas at less than 100 psig has been ignored for lpg recovery. Whenever such gas is processed, it is first compressed to above 300 psig before processing. However the process of the present invention, used for separation of various materials of close boiling points generally uses a distillation tower arrangement.

This invention is particularly concerned with separation of heavier components from natural gas.

Ethane recovery is similar to lpg recovery in concept except that more energy is required for refrigeration and reflux compression. This process also applies to situations where the low pressure gas is sold at higher pressures but the benefits compared to other processes are much less than that described in the first paragraph where, essentially there are no other processes that are ever considered unless the desired residue gas pressure for the sales pipeline is above 200 psig. The use of this technology for the recovery of ethylene in ethylene plants, will reduce the power requirements and capital cost of the Demethanizer portion of these plants. The above U.S. patent of the applicant was described as being very applicable to the separation of ethane and ethylene. That patent could also be used for the Demethanizer in an Ethylene Plant but it is believed that this patent will be an improvement when combined with that patent.

This invention relates to distillation processes for the separation of close boiling point materials. Such a process is used in the extraction of various materials generally using a distillation tower. Examples of such separations are:

1. Recovering ethane from natural gas
2. Recovering propane from natural gas
3. Recovering carbon dioxide from natural gas
4. Recovering helium from natural gas 5. Rejecting nitrogen from natural gas
6. Recovering ethylene in ethylene plants.

This patent has optimal advantage when utilised in conjunction with a two tower or multi-tower process described in the above United States patent. It may also be used to advantage with other distillation patents for example the various arrangements described in patents held by the Ortloff Corporation.

SUMMARY OF THE INVENTION

It is one object of the present invention to provide an improved method for separation of residue gases from natural gas which provides improved efficiencies particularly for processing gases where the residue gases are supplied at low pressure.

It is one object of the present invention, therefore, to provide an improved distillation process which obtains as good or better separation recoveries but with an improved thermodynamic efficiency and in many cases reduced equipment cost. It is expected that this patent will improve the Demethanizer portion of ethylene production plants.

It is another object of the present invention to provide economical means of recovering ethane and/or lpg from low pressure natural gas that is otherwise ignored for liquid recovery.

According to the first aspect of the invention it is provided a method of separating heavier components from natural gas comprising:

providing a distillation tower arrangement for separating the heavier components discharged at the bottom of the tower arrangement from lighter gas discharged at the top of the tower arrangement;

providing a feed gas containing the components under a first pressure sufficient to supply the gas to the distillation tower arrangement;

separating the feed gas into a first proportion and a second proportion, where neither proportion is zero feeding the first proportion to the distillation tower arrangement at a feed position thereon between the top and bottom thereof for separation within the distillation tower arrangement;

compressing the second proportion to a pressure higher than the first pressure, extracting heat from the compressed second proportion to effect condensation thereof, sub-cooling the compressed condensed second proportion, expanding the compressed condensed second proportion to the first pressure and supplying the second proportion after expansion to the distillation tower arrangement at a position thereon adjacent the top of the distillation tower arrangement so as to cause cooling of the materials in the distillation tower arrangement.

The lighter gas discharged at the top of the tower arrangement is supplied at a pressure which is selected depending the requirement of the supply. In many cases this is a high pressure requirement greater than 100 psig and often of the order of 500 psig. This invention however has particular applicability and advantage when the supply pressure is less than 100 psig thus leading to a low operating pressure.

Preferably the second proportion is sub-cooled by cool from the lighter gas.

Preferably the second proportion is further sub-cooled by a refrigerant.

Preferably the feed gas is dehydrated prior to separation.

Preferably the feed gas is dehydrated by a molecular sieve.

Preferably the first proportion is cooled by cool from a re-boiler of the tower arrangement.

In one example the tower arrangement includes at least two separate towers at different pressures such that the heavier product from the higher pressure tower is expanded and fed to the lower pressure tower. In one arrangement of this example, the lighter gas from the top of the lower pressure tower is fed back to the feed gas for reprocessing. In an alternative arrangement, the gas is flared.

Preferably the lighter gas from the top of the tower arrangement is supplied to a low pressure pipe line system having a supply pressure of the order of 75 psi.

Preferably the lighter gas from the top of the lower pressure tower is added to the second proportion for processing therewith and supply to the top of the higher pressure tower.

Preferably the supply gas is separated from a crude oil supply and wherein the separated heavier components are returned to the crude oil as a supplement thereto.

Preferably the separated lighter gas is flared.

According to a second aspect of the invention there is provided an apparatus for separating heavier components from natural gas comprising:

a distillation tower arrangement for separating the heavier components discharged at the bottom of the tower arrangement from lighter gas discharged at the top of the tower arrangement;

a feed gas supply line for a feed gas containing the components under a first pressure sufficient to supply the gas to the distillation tower arrangement;

means for separating the feed gas into a first proportion and a second proportion, where neither proportion is zero a supply duct for feeding the first proportion to the distillation tower arrangement at a feed position thereon between the top and bottom thereof for separation within the distillation tower arrangement;

a compressor for compressing the second proportion to a pressure higher than the first pressure;

means for extracting heat from the compressed second proportion to effect condensation thereof a heat exchanger for sub-cooling the compressed condensed second proportion;

means for expanding the compressed condensed second proportion to the first pressure;

and a second supply duct for supplying the second proportion after expansion to the distillation tower arrangement at a position thereon adjacent the top of the distillation tower arrangement so as to cause cooling of the materials in the distillation tower arrangement.

BRIEF DESCRIPTION OF THE DRAWINGS

One embodiment of the invention will be described hereinafter in conjunction with the accompanying drawing in which.

DETAILED DESCRIPTION

Figure 1:
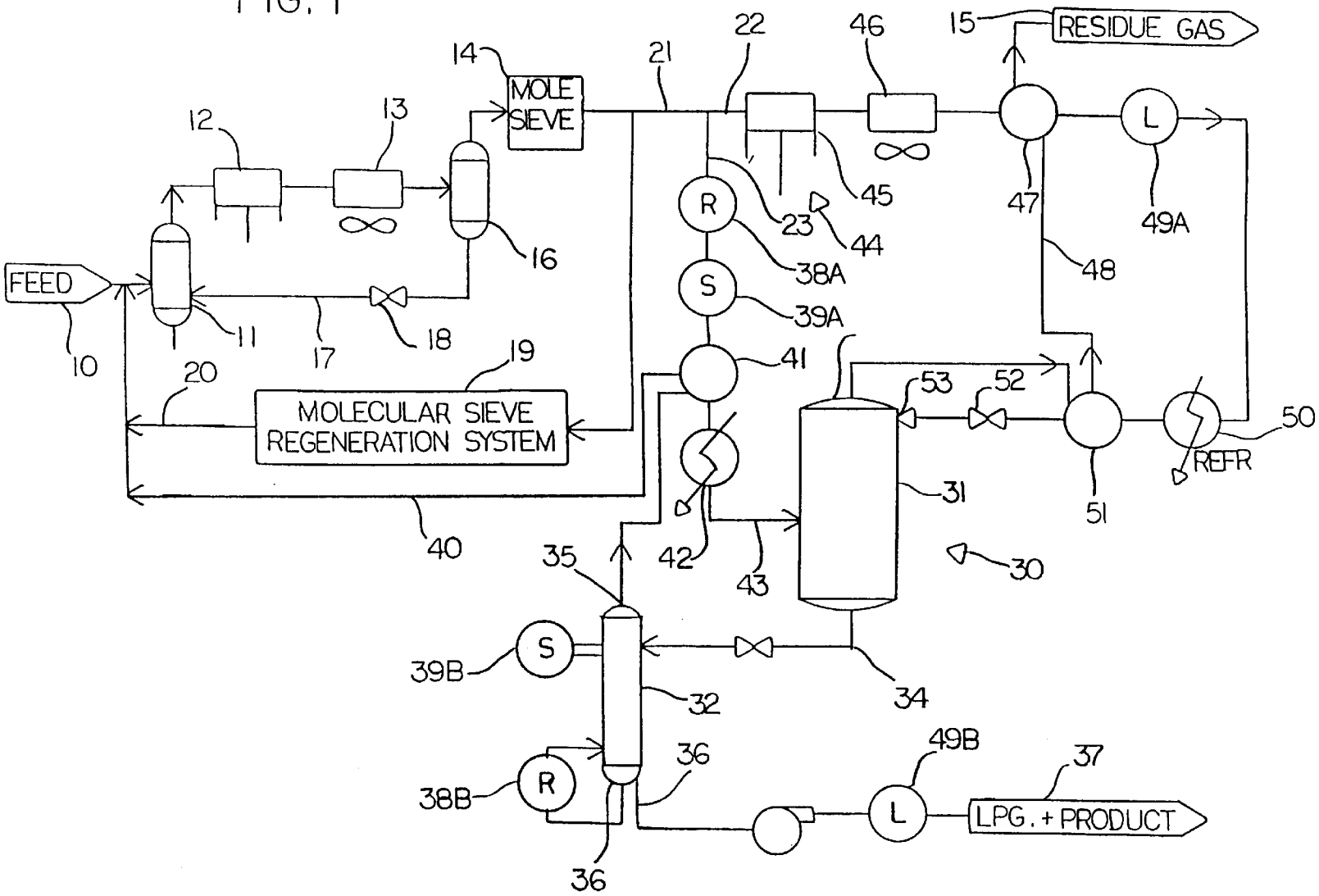
FIG. 1 is a schematic illustration of the elements of a first process according to the present invention using the two tower system of the above prior patent which is particularly but not exclusively designed for supplying the residue gas at a low pressure.

Turning firstly to FIG. 1 there is shown an arrangement for separating lpg+ products from a feed of natural gas leaving a residue sales gas for sale at low pressure that is less than 100 psig.

The arrangement provides a feed supply line 10 which feeds to an inlet separator 11 which acts to separate gas from any incoming liquid. The liquid can be handled in a number of different ways including supply to the free water knock out system of the crude oil processing plant in arrangements where such is available. Alternatively, the liquid can be passed through a dehydrator and fed to the de-ethanizer.

The inlet gas from the inlet separator 11 is supplied to an inlet compressor 12 having an after-cooler 13. The gas is compressed to a sufficient pressure in the compressor 12 so that after the compressor the gas can be dehydrated in a molecular sieve 14 and processed in the lpg recovery plant and then has sufficient pressure for the gas entering the sales pipeline 15.

Prior to entering the dehydrator 14 in the form of a molecular sieve, a further liquid separator 16 is provided for recycling a liquid through a return line 17 having a let down valve 18.

As stated above, the arrangement described herein is particularly designed for low pressure residue gas. However if the desired pipeline pressure in the residue gas is intended to be above 600 psig, it is preferred that compression be added to the residue gas downstream of the recovery plant so that the tower assembly described hereinafter can operate at approximately 400 psig.

After the inlet gas is compressed, after-cooled and the liquids extracted in the separator 16, the gas is dehydrated in the dehydrator 14 which is preferably a molecular sieve as described above or can possibly be a "Dryso"™ process which is a tri-ethylene glycol process. In such an arrangement a sophisticated regeneration system as shown can be provided using extractive distillation to reduce the water content of ethylene glycol. The extracted material from the regeneration system is returned to the feed as indicated in the supply line 20.

Downstream of the dehydrator 14, there is provided a supply line 21 which is divided into two supply lines 22 and 23 acting to effect a proportional division of the feed in the supply line 21. Each line includes a flow control valve 22A and 23A which are controlled using conventional flow control systems well known to one skilled in the art to maintain the required proportions depending upon the measurement of various parameters of the process.

The process further includes a processing tower arrangement generally indicated at 30 including a high pressure tower 31 and a low pressure tower 32. These two towers are generally as described in the above United States patent and the disclosure of that document is incorporated herein by reference. The two towers each comprise a distillation tower section for effecting separation of the components in the feed so that the high pressure tower section 31 discharges lighter gas components at an upper discharge 33 and heavier components at a lower discharge 34. The low pressure tower 32 has an upper discharge 35 and a lower discharge 36. The upper gas discharge 33 provides the residue sales gas 15 while the bottom discharge 36 of the low pressure tower provides the heavier lpg+ product 37.

The first portion of the feed gas divided into the supply line 23 is supplied as a feed to the lower part of the high pressure tower 31. Prior to supply to the tower arrangement, the gas in the supply line 23 is passed through a heat exchanger R which includes a component 38A on the line 23 and second component 38B forming a reboiler for material at the bottom of the low pressure tower component 32. Thus the heat exchanger R extracts cool into the component 38A to cool the supply on the line 23 and applies heat to the component 38B acting as a reboiler to return the material as a side feed to the lower part of the lower pressure component 32.

The supply on the line 23 is further passed through a second heat exchanger S having a first component 39A and a second component 39B which again acts to extract cool for the material in the line 23 and acts as a heat supply for a side reboiler on the lower pressure tower component 32.

Gas from the top discharge 35 of the low pressure tower 32 is returned to the feed through a supply duct 40. Prior to return to the feed, cool is extracted from the return gas in a further heat exchanger 41 and that cool is applied to the feed on the line 23.

Finally a refrigerator unit 42 is used to apply external cooling to the feed prior to injection into the high pressure tower component 31 at a feed position 43.

The second proportion on the line 22 is passed to a compressor system 44 including a compressor 45 and a heat extractor 46. The second proportion of the gas is compressed to a pressure in the range 500 to 1400 psig so that it can be cooled and condensed and used for injecting into the tower arrangement as a cooling top supply.

The prior patent and the prior published application of the present inventor disclose the use of liquid injection at the top of the high pressure tower for maintaining a cool temperature in the high pressure tower. In the prior application this is termed as "reflux". However in the present invention the compressed material includes a component of the original supply from the feed 10 and in addition includes a component from the discharge gas from the discharge outlet 35 of the low pressure tower.

The second proportion is thus compressed in the compressor system 44 and cooled by the cooling arrangement 46. It is then passed through a heat exchanger 47 which extracts cool from the residue gas and supply line 48. Further cooling is effected in a further heat exchanger L which includes first component 49A on the line 22 and a second component 49B extracting cool from the product 37. Further refrigeration cooler 50 is provided using external refrigerant. Downstream of the refrigerator 50 is provided a further heat exchanger 51 extracting cool from the residue gas on the supply line 48.

After the passage through the heat exchangers, the second proportion of the feed is usually totally condensed and sub-cool is provided by the heat exchanger 51. The second proportion of the feed is then passed through a let down valve 52 before injection into the high pressure tower 31 at a feed entry 53.

The compression of the second proportion only provides significant advantages in economical recoveries. In the past, all processes considered compressing all of the inlet gas to the high pressure before processing. In the present invention only the proportion in the line 22 is compressed thus avoiding the necessary power requirements for compression and also reducing capital cost.

In some situations a phase envelope of the second proportion gas has to be considered so that an optimum pressure is chosen which provides optimum cool recovery by the gas/liquid and thus the most economical system. The above optimum cool recovery is usually at a pressure that is close to the maximum cool recovery.

Figure 2:
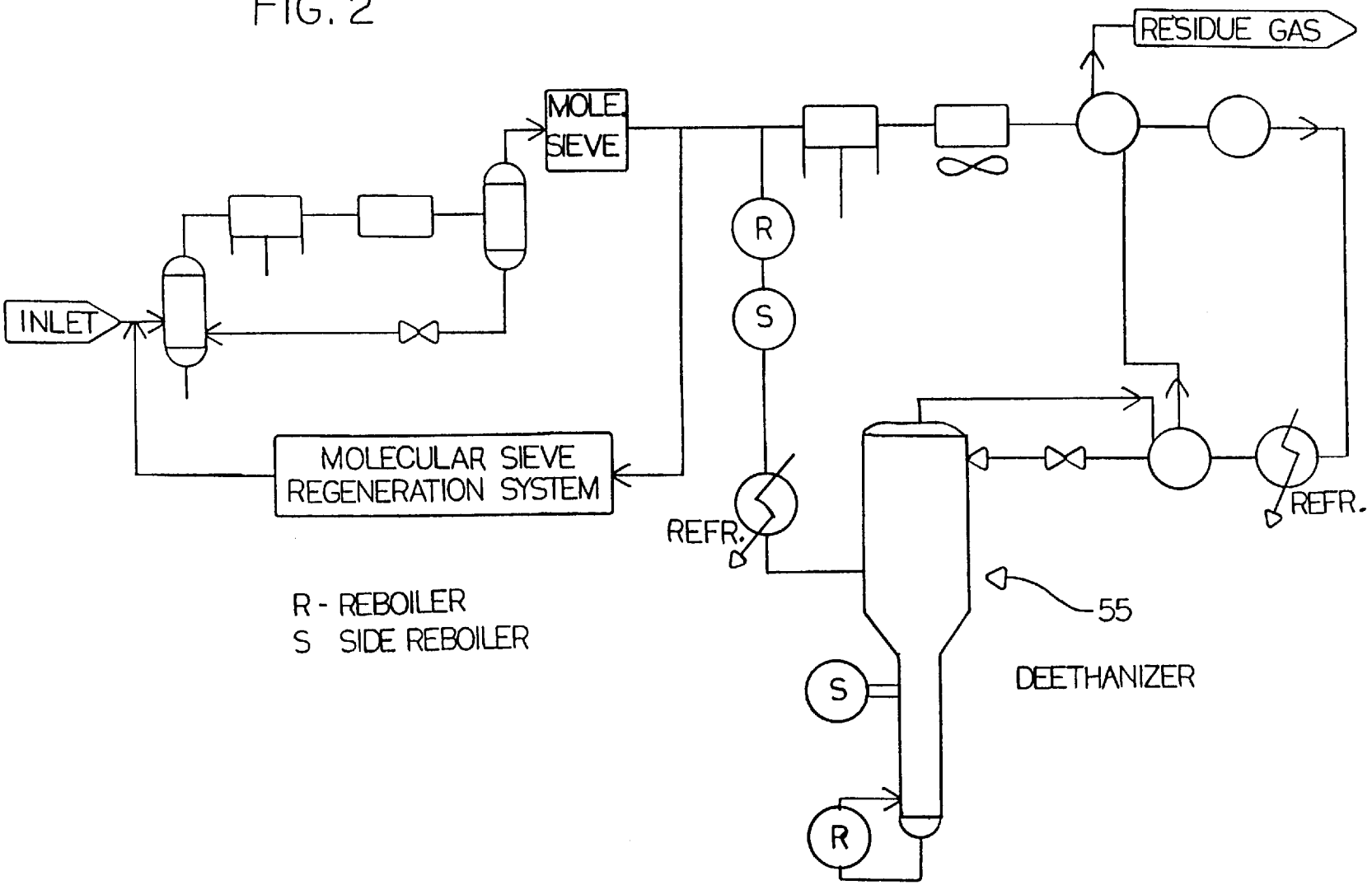
FIG. 2 is a schematic illustration of the elements of a second process according to the present invention using the a single tower.

Turning now to FIG. 2 there is shown substantially the same arrangement having the same first and second proportions divided into the first and second feed systems. In this arrangement, however, the two tower process is replaced by a more conventional single tower process as indicated in the single tower 55 as is well known from the processes of Ortloff.

Figure 3:
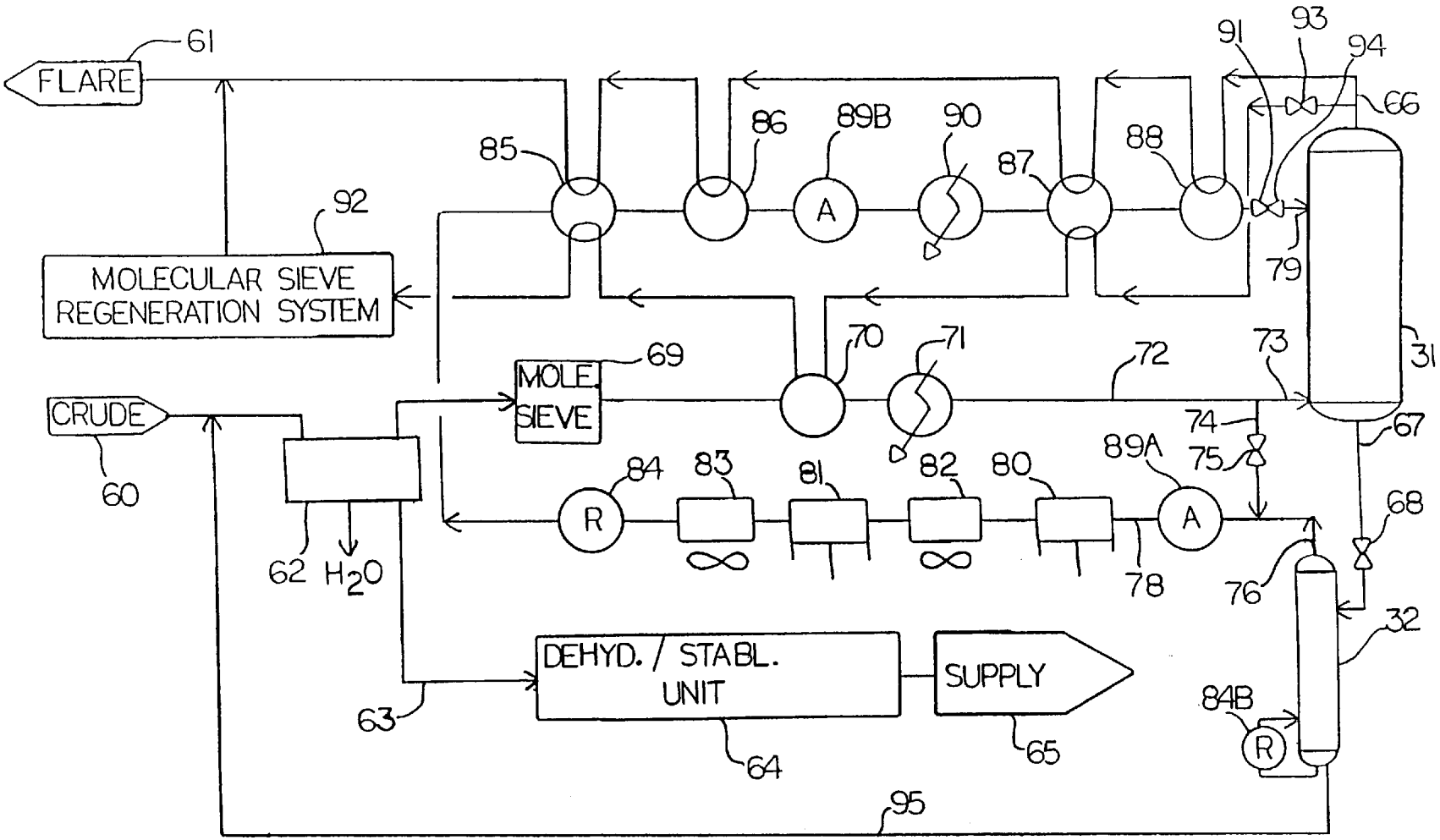
FIG. 3 is a schematic illustration of the elements of a third process according to the present invention using the two tower system of the above prior patent and which is particularly but not exclusively designed for returning the extracted components to a crude oil processing plant to supplement the crude oil and for flaring the residue gases.

Turning now to FIG. 3, there is shown a similar system to that of FIG. 1 which utilises the two tower process of FIG. 1 including the high pressure tower 31 and the low pressure tower 32.

This process operates similar to that previously described and is used for enhancing or supplementing crude oil processing from a crude oil supply 60. In this arrangement the residue gas is supplied to a flare 61 so that it is effectively at zero pressure.

The crude oil is supplied to a separator 62 where the liquid is withdrawn on a line 63 and supplied to a dehydrator and stabilisation system schematically indicated at 64. This can be of the type known as a "feed water knockout" but other processing systems can be used. From the processing system the crude supply is indicated at 65.

The discharge gas from the top of the high pressure tower is discharged on a line 66 and is fed to the flare 61. The discharged liquid at the bottom of the high pressure tower is fed through a supply line 67 and a let down valve 68 to provide a feed to the top of the low pressure tower 32.

The gas separated from the crude supply in the separator 62 is supplied to a molecular sieve 69 for dehydration of the gas. The gas is passed through the first heat exchanger 70 and a refrigeration unit 71. The proportional separation is effected between the lines 72 from the refrigerator 71 so that the first portion is supplied on the line 73 to a feed location 74 on the high pressure tower. The second proportion is fed on a line 74 through a let down valve 75 so that the feed is lowered in pressure to the same pressure as the discharge 76 from the top of the low pressure tower. The feed on the line 74 is thus added to the gas discharge from the outlet 76 and this combined flow is passed through a line 78 to an inlet 79 at the top of the high pressure tower 31. The gas in the line 78 is passed through a two-stage compressor including compressor components 80 and 81 and cooling components 82 and 83.

A heat exchanger R including a first component 84A and a second component 84B extracts cool from the reboiler at the bottom of the low pressure tower 32. Further heat exchangers 85, 86, 87 and 88 act to extract cool from the discharge gas from the discharge 66. A further heat exchanger A includes a component 89A and a second component 89B so as to extract cool from the gas upstream of the compressor components. A refrigerant system 90 corresponds to the refrigeration system 50 of FIG. 1. A let down valve 91 corresponds to the let down valve 52. The compressed, condensed and sub-cooled supply is expanded back to the pressure of the high pressure tower and is injected as a reflux-cooled supply into the top of the high pressure tower previously described.

The discharge from the top of the high pressure tower through the line 66 is divided into two sections passing to the flare 61. One proportion passes through the heat exchangers 85, 86, 87 and 88. A second proportion passes through the heat exchanger 70, the heat exchanger 85 and to the molecular sieve regeneration system generally indicated at 92. Two valves 93 and 94 let down the pressure from the pressure of the high pressure tower to the flare pressure of approximately zero.

Again therefore in the arrangement of FIG. 3, the second proportion of the divided supply is compressed for injection into the high pressure tower at the cooling feed at the upper end. The second part of the feed on the line 73 is not compressed thus providing significant processing economies.

The liquid from the bottom of the low pressure tower extracted from the otherwise waste or flare gas is returned through a line 95 as a supplement to the feed thus enhancing the supply crude 65.

When the residue gas goes to flare, recovery of C3+ is similar in concept to the arrangement shown in FIG. 3 for the recovery of C4+. There will be some change in heat exchanger arrangement and the temperatures will be much colder. Similarly, the recovery of C2+ will also be similar but colder with a different heat exchanger arrangement. One big difference in the arrangement for C2+ and C3+ in comparison with FIG. 3 is that these will be produced as a separate product rather than recycling the liquid into the inlet crude stream.

The arrangement of FIG. 3 could also be modified so that the C4+ could also be recovered as a separate product. However normally if a separate product is desired, recovery of C3+ is desirable also. The effects of recycling the recovered C4+ to the inlet crude stream is to reduce the content of C3 and allows the components in the stabilised crude.

When treating gases at the low pressure similar to that of FIG. 3, there is some incentive to mount the high pressure tower above the low pressure tower so that there does not have to be such a large pressure drop between the towers. This raises the suction pressure for the compressor 80 but also raise the operating temperature of the reboiler 84B.

All of these arrangements have the advantage that the overhead from the low pressure tower is recycled to the high pressure tower. This provides an effective reflux supply for the high pressure tower. For example in the case of propane recovery, the low pressure tower overhead is rich in ethane which makes very good reflux for separating propane from natural gas.

The flow split in the feed to the bottom of the high pressure tower does not need to be controlled by a ratio flow control. The split stream of dehydrated feed to the recycle compressor is controlled to maintain the suction pressure of that compressor. Thus the compressor 80 at constant speed will deliver a constant flow rate to the high pressure tower thus compensating for the volume of gas exiting from the discharge 76 by taking a portion of the feed on the line 72. This is also has the effect that when the plant is turned down in flow rate or composition, the percentage recovery of liquid product will increase.

The power requirement for the Feed Compressor is minimized since the gas is only compressed as much as required considering pressure drops in the dehydrator and lpg recovery process. When the desired Residue Gas pressure is the same or less than the Feed Pressure, very little Feed Compression is required, resulting in much less power requirement for this process than any other process.

Typical propane recoveries from this process are 90% using the two towers as shown in FIG. 1. When this process is configured with a three tower process (our United States patents 1988 and 1997 patents), 95% propane recoveries can be easily achieved.

In addition to saving energy, the lower power requirement results in a smaller compressor installation and a reduced capital cost compared to other processes.

Figure 4:
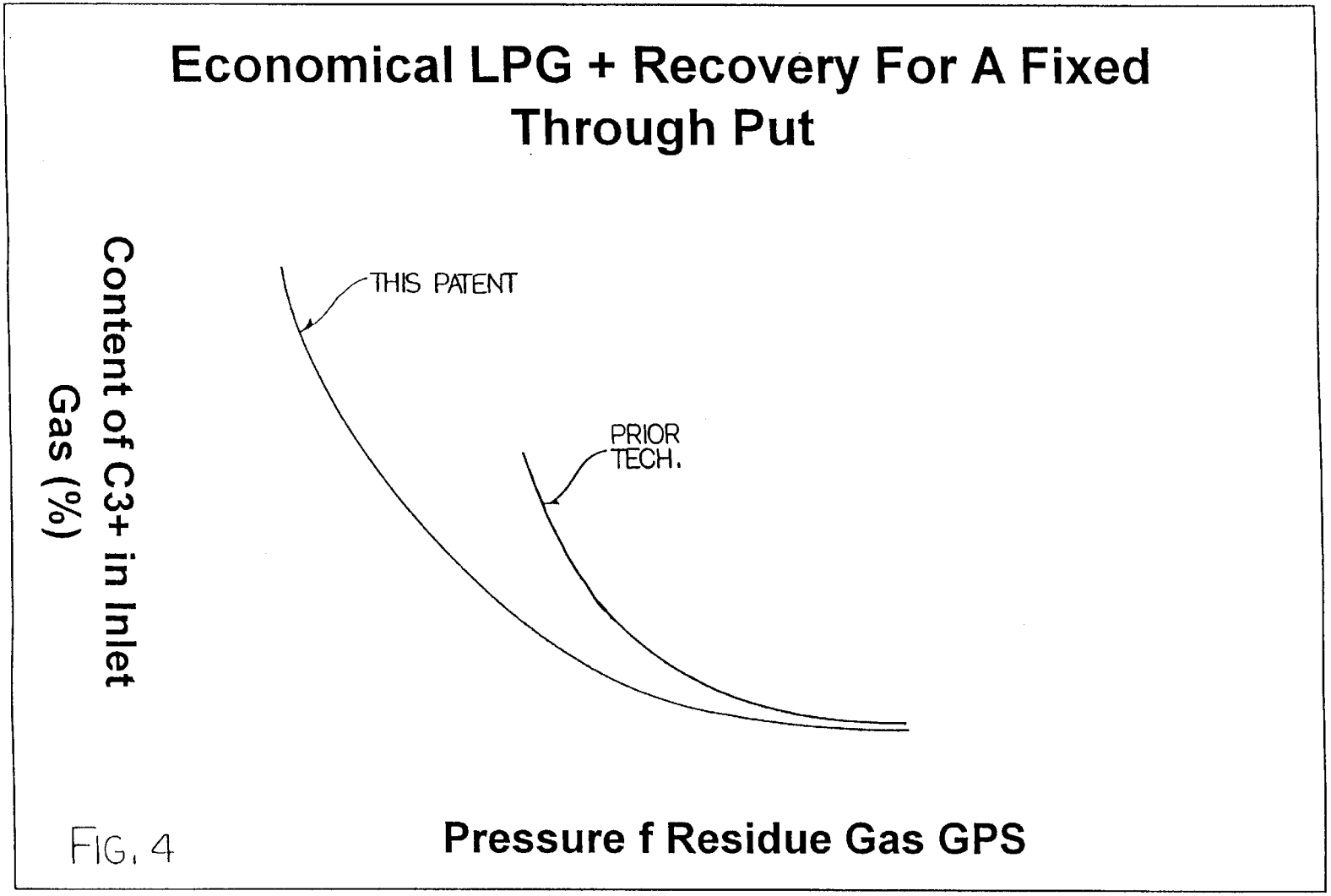
FIG. 4 is a sketch indicating the lowest propane plus content recovery.

FIG. 4 is a sketch indicating the lowest propane plus content recovery. Note that processes using the Reflux Compressor can recover lpg from much lower Feed Pressures as long as the lpg concentration in the gas is high enough. The Reflux Compressor adds a considerable number of applications for economical lpg recovery compared to other processes that do not have a Reflux Compressor.

Figure 5:
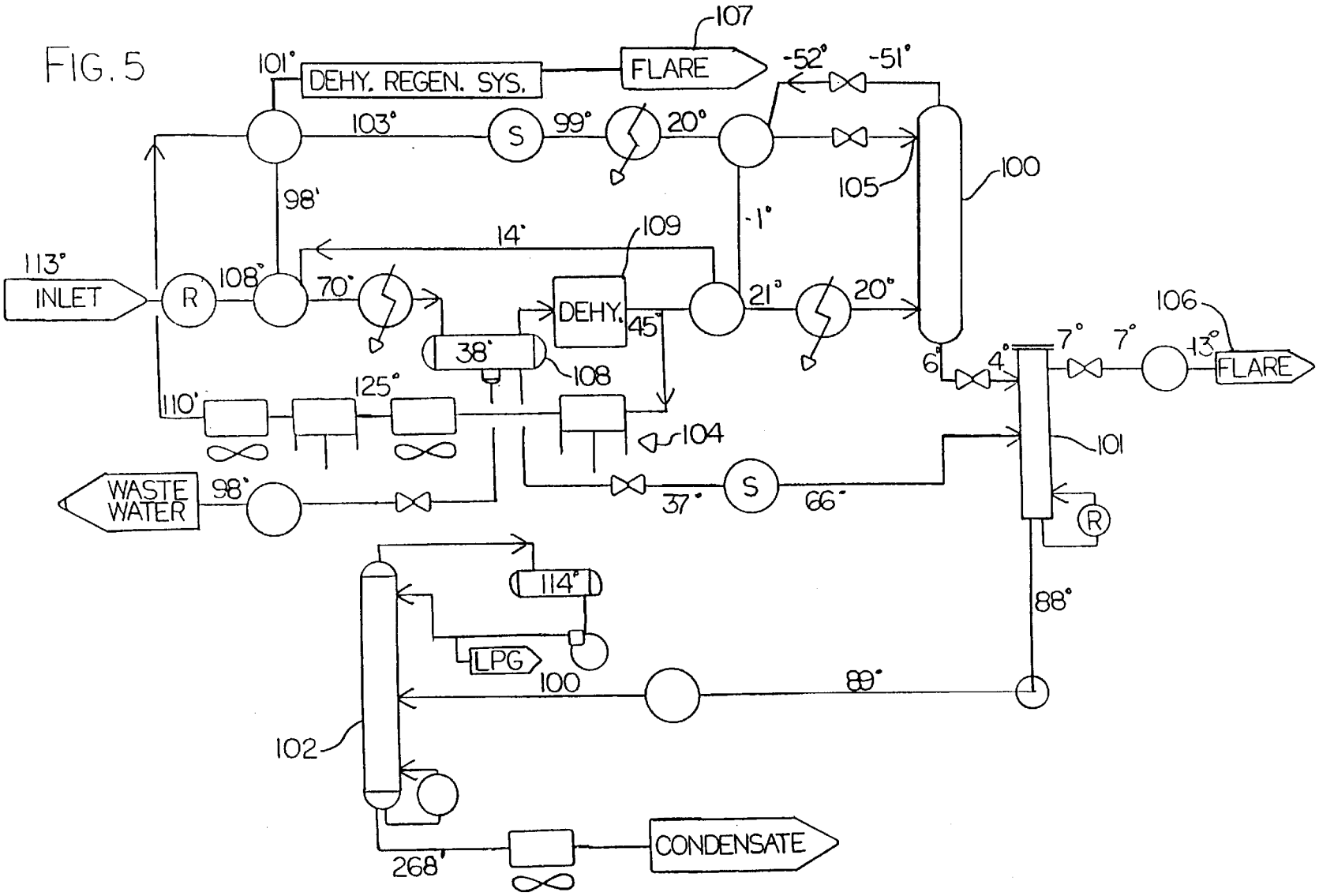
FIG. 5 is a schematic illustration of the elements of a fourth process according to the present invention.

Turning now to FIG. 5 there is shown a further modified arrangement in which there is a three tower system including towers 100, 101 and 102. In this arrangement the feed is again split to provide a proportional flow at the location 103 and a portion of the feed is compressed through the system 104 as previously described and fed at the reflux location 105 to the tower 100. In this arrangement the gas from the top of the second tower 101 is sent to flare 106. Also in this arrangement the gas from the top of the tower 100 is sent to flair 7. In this arrangement there is provided a water separation at a condenser 108 which is located upstream of a dehydrator 109.

Note that the dehydrator 109 is located after 90° of the water has been condensed out of the gas at 38 F. The refrigerant temperature in the chiller is 33 F so there is no danger of freezing and the chiller assures a maximum temperature into the dehydrator. Location of the dehydrator after most of the water has been removed greatly reduces it's size and regeneration heat requirement. Note also that the overhead from the de-ethanizer is not recycled, it is sent to flare along with the other residue gas from the process. Heat for the de-ethanizer reboiler is obtained from the process as we normally do in our other designs. This means that heating medium is not required for this tower, but it is required for the debutanizer. There may be situations where having this extra tower is not warranted, trays could be added below the bottom feed on the gas fractionator and the reboiler added to that tower. That would be the conventional Ortloff patent.

All the metallurgy is carbon steel except for the top feed to the gas fractionator. For this design, it would likely be wise to have the top reflux meet the gas fractionator overhead in a small stainless vessel having one or two trays. This stainless steel vessel would be mounted on top of the main gas fractionator column which would have a −50 F design temperature so could be Charpy-tested carbon steel.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A method of separating heavier components from natural gas comprising:

providing a distillation tower arrangement for separating the heavier components discharged at the bottom of the tower arrangement from lighter gas discharged at the top of the tower arrangement;

generating a residue gas stream from the lighter gas components for supply at a residue gas pressure to a downstream process;

providing a feed gas containing the components under a feed pressure;

separating the feed gas into a first proportion and a second proportion, where neither proportion is zero;

feeding the first proportion at the feed pressure to the distillation tower arrangement at a feed position thereon between the top and bottom thereof for separation within the distillation tower arrangement;

compressing the second proportion to an increased pressure higher than the feed pressure, the increased pressure being selected to provide a desired operating pressure in the distillation tower arrangement and being different from the residue gas pressure;

extracting heat from the compressed second proportion to effect condensation thereof;

sub-cooling the compressed condensed second proportion;

expanding the compressed condensed second proportion and supplying the second proportion after expansion to the distillation tower arrangement at a position thereon adjacent the top of the distillation tower arrangement so as to cause cooling of the materials in the distillation tower arrangement.

2. The method according to claim 1 wherein the residue gas pressure is less than 100 psi.

3. The method according to claim 1 wherein the second proportion is sub-cooled by cool from the lighter gas.

4. The method according to claim 3 wherein the second proportion is further sub-cooled by a refrigerant.

5. The method according to claim 1 wherein the feed gas is dehydrated prior to separation.

6. The method according to claim 5 wherein the feed gas is dehydrated by a molecular sieve.

7. The method according to claim 1 wherein the first proportion is cooled by cool from a re-boiler of the tower arrangement.

8. The method according to claim 1 wherein the tower arrangement includes at least two separate towers at different pressures thus defining a higher pressure tower and a lower pressure tower each arranged to separate a lighter product at the top and a heavier product at the bottom of the respective tower arranged such that the heavier product from the higher pressure tower is expanded and fed to the lower pressure tower and wherein at least a portion of the lighter gas from the top of the lower pressure tower is added to the second proportion for processing therewith and supply to the top of the higher pressure tower.

9. The method according to claim 8 wherein the lighter gas from the top of the lower pressure tower is fed back to the feed gas for reprocessing such that a portion only of the lighter gas is combined with the second proportion.

10. The method according to claim 1 wherein the residue gas pressure is of the order of 75 psi and wherein the residue gas is fed to a pipe line at said pressure.

11. The method according to claim 10 wherein the lighter gas from the top of the lower pressure tower is fed back to the feed gas for reprocessing such that a portion only of the lighter gas is combined with the second proportion.

12. The method according to claim 8 wherein the whole of the lighter gas from the top of the lower pressure tower is added to the second proportion for processing therewith and supply at a common point to the top of the higher pressure tower.

13. The method according to claim 1 wherein the supply gas is separated from a crude oil supply and wherein the separated heavier components are returned to the crude oil supply as a supplement thereto.

14. The method according to claim 13 wherein the seperated lighter gas is flared.

15. The method according to claim 13 wherein the whole of the lighter gas from the top of the lower pressure tower is added to the second proportion for processing therewith and supply at a common point to the top of the higher pressure tower.

16. The method according to claim 13 wherein the lighter gas from the top of the lower pressure tower is flared.

17. The method according to claim 13 wherein there is provided a third tower and wherein the heavier components from the bottom of the lower pressure tower are fed to the third tower.

18. A method of separating heavier components from natural gas comprising:

providing a distillation tower arrangement for separating the heavier components discharged at the bottom of the tower arrangement from lighter gas discharged at the top of the tower arrangement;

providing a feed gas containing the components for supply to the distillation tower arrangement;

the tower arrangement including at least two separate towers at different pressures thus defining a higher pressure tower and a lower pressure tower each arranged to separate a lighter product at the top and a heavier product at the bottom of the respective tower;

taking the heavier product from the bottom of the higher pressure tower which is then expanded and fed to the lower pressure tower;

separating the feed gas into a first proportion and a second proportion, where neither proportion is zero;

feeding the first proportion to the distillation tower arrangement at a feed position thereon between the top and bottom thereof for separation within the distillation tower arrangement;

adding at least a portion of the lighter gas from the top of the lower pressure tower to the second proportion for processing therewith and supply to the top of the higher pressure tower;

compressing said second proportion and said at least a portion of the lighter gas from the top of the lower pressure tower to a pressure higher than the feed pressure;

extracting heat from said second proportion and said at least a portion of the lighter gas from the top of the lower pressure tower to effect condensation thereof;

sub-cooling said second proportion and said at least a portion of the lighter gas from the top of the lower pressure tower;

expanding said second proportion and said at least a portion of the lighter gas from the top of the lower pressure tower;

and supplying said second proportion and said at least a portion of the lighter gas from the top of the lower pressure tower after expansion to the higher pressure tower together at a common position thereon adjacent the top so as to cause cooling of the materials in the distillation tower arrangement.

19. The method according to claim 18 wherein the lighter gas from the top of the lower pressure tower is fed back to the feed gas.

20. The method according to claim 18 wherein the whole of the lighter gas from the top of the lower pressure tower is added to the second proportion for processing therewith and supply to the top of the higher pressure tower.

* * * * *